US005332605A

United States Patent [19]

DeLamar

[11] Patent Number: 5,332,605

[45] Date of Patent: Jul. 26, 1994

[54] HOLLOW, DECORATIVE OBJECT CONTAINING NOVELTIES

[76] Inventor: Kristen DeLamar, 24355 Marquis Ct., Laguna Hills, Calif. 92653

[21] Appl. No.: 36,531

[22] Filed: Mar. 24, 1993

[51] Int. Cl.[5] ..... A63H 33/04

[52] U.S. Cl. ..... 428/15; 52/576; 52/596; 428/34.1; 446/85

[58] Field of Search ..... 428/34.1, 34.4, 542.4, 428/7, 15, 542.8; 215/12.1, 12.2; 446/85; 52/576, 596

[56] References Cited

U.S. PATENT DOCUMENTS

| | | | |
|---|---|---|---|
| 259,724 | 6/1882 | Sims | 428/34.1 X |
| 1,657,997 | 1/1928 | Hyten | 428/34.4 |
| 3,524,280 | 8/1970 | McKinnon | 428/34.4 X |
| 4,964,831 | 10/1990 | Wolff | 428/542.4 X |

*Primary Examiner*—Henry F. Epstein
*Attorney, Agent, or Firm*—Gary Appel

[57] ABSTRACT

A hollow decorative object is disclosed which contains inside one or more novelty objects. The hollow decorative object is formed of a hard, but unfired clay material, that is capable of being cut to form an opening into the hollow decorative object through which the one or more novelty objects can be removed without destroying the hollow decorative object. The hollow object may be formed into the general shape of an egg having a flattened base region on which said hollow decorative object can stand without tipping over. The base region is formed having a thickness enabling the easy cutting of an aperture therein through which the one or more novelty objects can be removed from the hollow decorative object without otherwise damaging it. In a variation, the hollow decorative object is formed in the shape of a child's square, six-sided building block, at least one side of the hollow decorative object being formed having a thickness enabling the easy cutting of an aperture therein through which the one or more novelty objects can be removed from the hollow decorative object without further damaging the object.

8 Claims, 2 Drawing Sheets

HOLLOW, DECORATIVE OBJECT CONTAINING NOVELTIES

BACKGROUND OF THE INVENTION

1. Field of the Invention

The present invention relates generally to the field of novelties and, more particularly, to objects containing small novelties that can be removed from the object without destroying the object.

2. Background Discussion

The making of hollow objects that contain smaller objects, such as small toys, inside is known. For example, hollow representations of animals, such as the Easter bunny or dinosaurs, are known that are made of edible chocolate. Inside the shell of the hollow object may be smaller edible object such as chocolate Easter eggs or small chocolate dinosaurs, which are "discovered" when the shell of the outside object is broken.

In other instances, as is the case for Mexican pinatas, the hollow outside object is constructed of a frangible or brittle material such that it breaks when struck, the object being that blind-folded children take turns at trying to break the pinanta, thereby releasing the objects-usually candy and/or toys, contained inside. Other brittle or frangible, hollow novelty-containing objects may be made from a fired clay such that the object itself has to be broken in order to obtain the objects or novelties contained inside.

A disadvantage of such a breakable, hollow object (and/or candy) containing novelties is obviously that the object must be broken in order to obtain the objects inside. Although this is desirable from the standpoint of obtaining the contained objects, it is undesirable when the hollow shell that has to be broken to obtain the internal objects is a decorative object itself which the owner would like to keep.

For these and other reasons, the present inventor has invented a hollow decorative clay object, such as an Easter egg, from which objects contained inside can be removed without destroying the object itself.

SUMMARY OF THE INVENTION

In accordance with the present invention there is provided a hollow decorative object containing inside one or more novelty objects. The hollow decorative object is formed of a hard but unfired clay material that is capable of being cut by a knife, so as to form an opening into the hollow decorative object through which the novelty object, or objects, can be removed without destroying the hollow decorative object.

In a preferred embodiment, the hollow decorative object is formed into the general shape of an egg and has a flattened base region on which the hollow decorative object can stand without tipping over. Preferably, the base region is formed having a thickness enabling the easy cutting of an aperture therein, through which the novelty objects can be removed from the hollow decorative object without otherwise causing damage thereto.

In a variation, the hollow decorative object is formed in the shape of a child's square, six-sided building block. In such case, at least one side of said hollow decorative object is formed having a thickness enabling the easy cutting of an aperture therein, through which the novelty object or objects can be removed from the hollow decorative object.

BRIEF DESCRIPTION OF THE DRAWINGS

The present invention can be more readily understood by consideration of the following detailed description when taken in conjunction with the accompanying drawings, in which.

In the various FIGS., identical elements and features are given the same reference number.

DETAILED DESCRIPTION OF THE INVENTION

Figure 1:
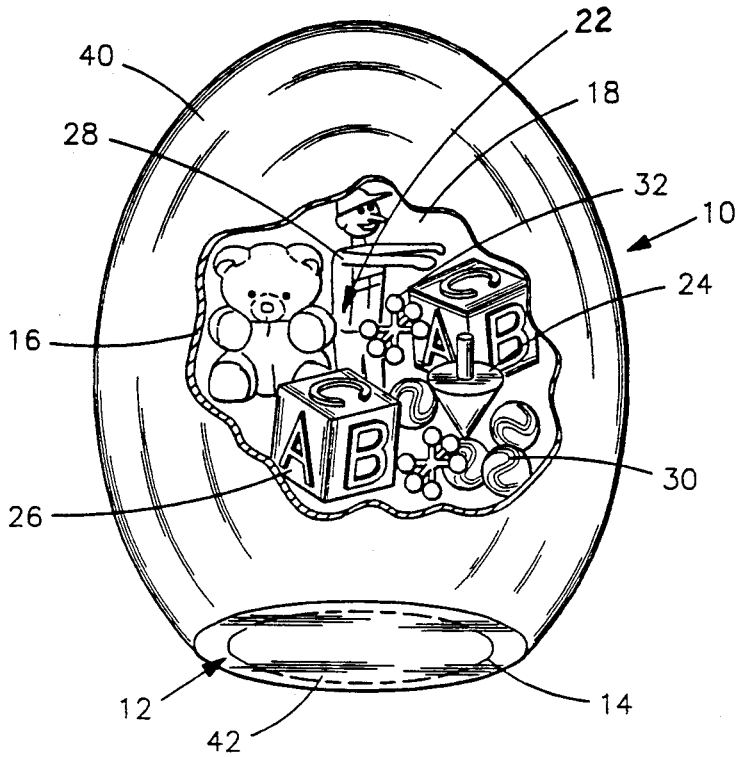
FIG. 1 is a perspective drawing of a decorative, hollow, unfired clay Easter egg-type object, the shell of which is shown partially cut-away to show a plurality of small gift items contained inside the shell.

There is shown in FIG. 1 a hollow decorative object or article 10 in accordance with a preferred embodiment of the present invention. By way of example and notion, decorative object 10 is shown in the shape of an egg, except that the object has a flat base region 12, with a base surface 14, which enables the object to stand upright on one end without tipping over.

Decorative object 10 is formed having a relatively thin, but rigid wall 16 which defines a inner region or chamber 16 and an outer shell 20. Shown contained in chamber 18 defined by wall 16 are a number of small children's toys 22, such as a top 24, a building block 26, a toy soldier 28, a ball 30, and jacks 32.

For decorative purposes, an outer surface 40 of object shell 20 is preferably decorated, as by scribing, carving, engraving and/or painting, in any desired decorative pattern or with one or more names. As a result, object 10 is a decorative object that will ordinarily want to be kept intact for display or as a remembrance, while at the same time it is obviously desirable to remove the contained toys 22 from the inside of object shell 20.

Toward this end, the present inventor has determined that object shell 20 can advantageously be constructed of a clay material, such as pottery clay (as opposed to children's molding clay) that is left to harden but is not fired to make the clay hard and brittle. Shell 20 is nevertheless sufficiently hard and shape-retaining that object 10 retains its shape and can be handled in a normal manner without being damaged or broken and without the decorations on shell outer surface 40 becoming damaged.

Figure 2:
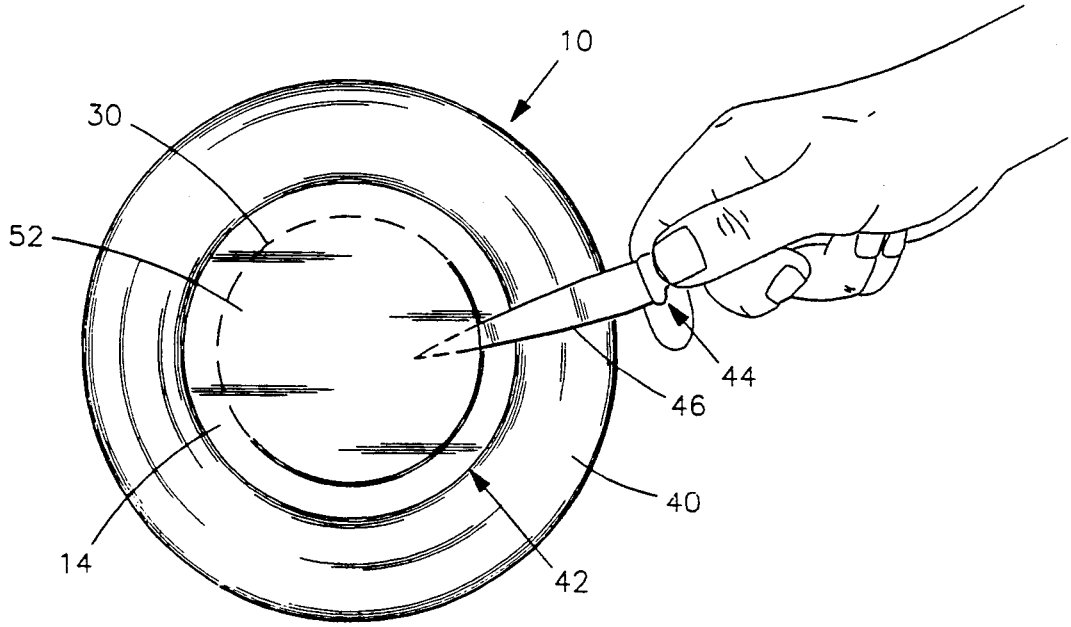
FIG. 2 is a bottom view of the object shown in FIG. 1, showing a base region of the object being cut open with a knife.

Base region 12 of object 10 (actually of shell 20) may be formed of a thinner clay material and/or may have a scribed cut line 42 FIGS. 1 and 2). Thus, by use of a knife 44 (FIG. 2) having a slender, sharp blade 46 a cut 50 can be made along line 42 so that a circular or oval base piece 52 can be removed from object shell base region 12 without otherwise damaging shell 20. With base region piece 52 remover, toys 22 can be removed from object shell 20 without having to break the shell.

After piece 52 has been removed from base region 12 and toys 22 have been removed from shell chamber 18, piece 52 can either be discarded or can be glued or cement back in place. However, when object 10 (minus toys 22) is set upright on base region 12 it cannot be seen whether or not cutout basion piece 52 has been replaced.

Thus, the decorative appearance of object 10 (that is, of shell 20) is maintained after toys 22 have been removed from the object in the above-described manner.

Figure 3:
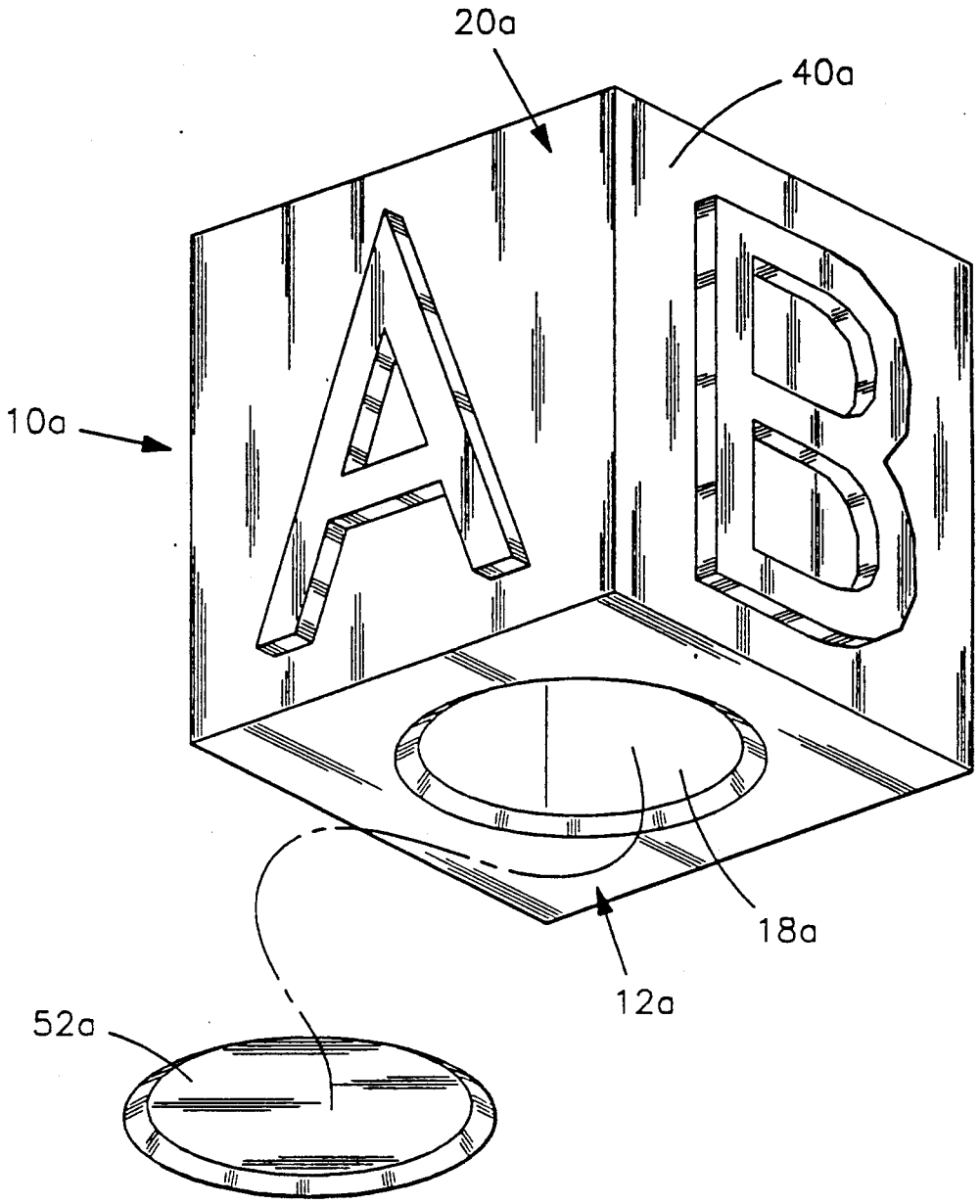
FIG. 3 is a perspective drawing of a variation hollow, unfired hollow clay object in the form of a child's building block, showing a circular opening having been cut in the bottom thereof to enable the removal of small novelties from inside the object.

A variation decorative, hollow object 10*a* is depicted in FIG. 3. Object 10*a* is shown as being in the shape of a square children's building block (instead of being egg shaped as above-described for object 10). As shown in FIG. 3, a piece 52*a* (corresponding to above-described base region piece 52) has a base region 12*a* of a shell 20*a* of object 10*a* and any toys 22 originally contained in an inner chamber 18*a* have been removed. Various decorations, such as letters "A" and "B" may be formed on an object outer surface 40*a*.

Object 10*a* is otherwise constructed in the same manner as described above for object 10, being made from an unfired clay material.

Although there has been described and illustrated a hollow, unfired clay object containing objects (such as toys) inside, and from which the novelties can be removed without destroying the shell object, in accordance with the present invention for purposes of illustrating the manner on may be used to advantage, it is to be appreciated that the invention is not limited thereto. Therefore, any and all variations and modifications that may occur to those skilled in the art are to be considered as being within the scope and spirit of the claims as appended hereto.

What is claimed is:

1. A hollow decorative object containing inside thereof, one or more novelty objects, said hollow decorative object being formed of a hard unfired clay material, said material being capable of being cut so as to form an opening into said hollow decorative object through which said one or more novelty objects can be removed without destroying said hollow decorative object.

2. The hollow decorative object as claimed in claim 1, wherein said hollow decorative object is formed into the general shape of an egg and having a flattened base region on which said hollow decorative object can stand without tipping over.

3. The hollow decorative object as claimed in claim 2, wherein said base region is formed having a thickness enabling the easy cutting of an aperture therein through which said one or more novelty objects can be removed from said hollow decorative object.

4. The hollow decorative object as claimed in claim 1, wherein said hollow decorative object is formed in the shape of a child's square, six-sided building block.

5. The hollow decorative object as claimed in claim 4, wherein at least one side of said hollow decorative object is formed having a thickness enabling the easy cutting of an aperture therein through which said one or more novelty objects can be removed from said hollow decorative object.

6. A hollow decorative object containing inside thereof one or more novelty objects, said hollow decorative object being formed of a hard but unfired clay material, said material being capable of being cut so as to form an opening into said hollow decorative object through which said one or more novelty objects can be removed without destroying said hollow decorative object, said hollow decorative object being formed into the general shape of an egg and having a flattened base region, said base region having a thickness enabling the easy cutting of an aperture therein through which said one or more novelty objects can be removed from said hollow decorative object.

7. A hollow decorative object containing inside thereof one or more novelty objects, said hollow decorative object being formed of a hard but unfired clay material, said material being capable of being cut so as to form an opening into said hollow decorative object through which said one or more novelty objects can be removed without destroying said hollow decorative object, said hollow decorative object being formed into the general shape of a child's square six-sided building block.

8. The hollow decorative object as claimed in claim 7, wherein at least one side of said hollow decorative object is formed having a thickness enabling the easy cutting of an aperture therein through which said one or more novelty objects can be removed from said hollow decorative object.

* * * * *